US009968520B2

(12) United States Patent
Tremblay et al.

(10) Patent No.: US 9,968,520 B2
(45) Date of Patent: May 15, 2018

(54) RECONSTITUTION DEVICE

(71) Applicants: Yan Tremblay, Orford (CA); Mathieu Viens, Granby (CA); Simon Hamel, Sutton (CA); Sylvain Cloutier, Magog (CA)

(72) Inventors: Yan Tremblay, Orford (CA); Mathieu Viens, Granby (CA); Simon Hamel, Sutton (CA); Sylvain Cloutier, Magog (CA)

(73) Assignee: Duoject Medical Systems Inc., Bromont, Quebec (CA)

( * ) Notice: Subject to any disclaimer, the term of this patent is extended or adjusted under 35 U.S.C. 154(b) by 523 days.

(21) Appl. No.: 14/392,019

(22) PCT Filed: Aug. 5, 2013

(86) PCT No.: PCT/CA2013/000684
§ 371 (c)(1),
(2) Date: Jan. 30, 2015

(87) PCT Pub. No.: WO2014/022909
PCT Pub. Date: Feb. 13, 2014

(65) Prior Publication Data

US 2016/0228331 A1 Aug. 11, 2016

(30) Foreign Application Priority Data

Aug. 9, 2012 (CA) ..... 2785130

(51) Int. Cl.
*A61J 1/20* (2006.01)
*A61J 1/14* (2006.01)
*A61J 1/06* (2006.01)

(52) U.S. Cl.
CPC ..... *A61J 1/2096* (2013.01); *A61J 1/1406* (2013.01); *A61J 1/2013* (2015.05); *A61J 1/2048* (2015.05);
(Continued)

(58) Field of Classification Search
CPC ..... A61J 1/062; A61J 1/1406; A61J 1/1425; A61J 1/1475; A61J 1/201; A61J 1/2013;
(Continued)

(56) References Cited

U.S. PATENT DOCUMENTS

2004/0116892 A1* 6/2004 Burroughs ..... A61J 1/2096 604/414
2011/0030845 A1* 2/2011 Chong ..... A61J 1/2089 141/328

(Continued)

*Primary Examiner* — Benjamin Klein

(57) ABSTRACT

A reconstitution arrangement for transferring the contents of a first container (136) with the contents of a second container (110) and subsequently retransferring the mixture to the first container (136), the arrangement including a transfer device (114) having a fluid passageway extending between first and second ends (111, 113), a cartridge holder (138) secured to second end (113) of the transfer device, the cartridge holder (138) having a needle (144, 145) with first and second piercing tips (117, 119), the first piercing tip (117) extending into the fluid passageway of the transfer device, a first container receiving portion (115) having the second piercing tip (119) extending therein and being arranged to receive the first container (136), a housing (118) secured to the cartridge holder with a plunger rod (122) within the housing, and a cover (130) extending over the transfer device (114), cartridge holder (138) and housing (118), the cover and transfer device having an interlocking arrangement to prevent removal of the cover (130) until activated by the second container (110).

12 Claims, 15 Drawing Sheets

(52) U.S. Cl.
CPC ..... *A61J 1/2089* (2013.01); *A61J 1/062* (2013.01); *A61J 1/1425* (2015.05); *A61J 1/1475* (2013.01); *A61J 1/201* (2015.05); *A61J 1/2055* (2015.05)

(58) Field of Classification Search
CPC ..... A61J 1/2048; A61J 1/2055; A61J 1/2089; A61J 1/2096
See application file for complete search history.

(56) References Cited

U.S. PATENT DOCUMENTS

2011/0106045 A1* 5/2011 Reynolds ..... A61J 1/2096 604/413
2012/0330280 A1* 12/2012 Reynolds ..... A61J 1/2096 604/520

* cited by examiner

RECONSTITUTION DEVICE

FIELD OF THE INVENTION

The present invention relates to a reconstitution system and more particularly, relates to a reconstitution device for filling a cartridge which may be then used in a pen device.

BACKGROUND OF THE INVENTION

Typically, a syringe is filled manually by aspirating a liquid pharmaceutical component from a pharmaceutical vial which has a penetrable closure. The syringe has a needle that penetrates the penetrable closure following which the syringe is typically filled by drawing air into the body of the syringe, aligning the needle with the vial's penetrable closure and inserting the needle through the penetrable closure into the vial. Subsequently, the vial is inverted and air is forced from the body of the syringe into the body of the vial. The plunger is then withdrawn to draw out the desired volume of the pharmaceutical component into the syringe and the needle is removed from the vial.

The above method is disadvantageous in that fact that the user is exposed to the unprotected needle tip and furthermore, loss of a pharmaceutical component can occur through the puncture point. This is particularly dangerous with certain pharmaceutical compounds such as toxic oncology pharmaceuticals. Still further, the sterility of the needle may be compromised during the process.

One requirement in the pharmaceutical industry is the filling of cartridges which are secured to an injection pen. These cartridges are frequently used where there exist a multi dose situation or metered amounts must be injected. A device for mixing the two pharmaceutical components for use in an injection pen is required.

SUMMARY OF THE INVENTION

It is an object of the present invention to provide a transfer device which may be utilized for reconstituting a pharmaceutical composition.

It is a further object of the present invention to provide a reconstitution arrangement wherein access to the components may not be had until use of the containers is commenced.

In the description of the present invention, reference will frequently be made to the use of a vial and a syringe. Typically, the vial will contain the medicant in a solid state while the syringe carries a liquid diluent. It is to be understood that other arrangements may be utilized such as the combination of two liquids. Still further, the terms "vial" and "syringe" do not limit the invention to the same as any other suitable containers may be utilized.

One use of the present invention may be reconstituting a composition which is then ready for injection from a standard cartridge. The cartridge may be attached to known injection devices such as injection pens.

According to one aspect of the present invention, there is provided a reconstitution arrangement for use in transferring the contents of a first container to mix with the contents of a second container and subsequently retransferring the mixture to the first container, the reconstitution arrangement comprising a transfer device, the transfer device having first and second opposed ends, the first end being open for receiving the second container, a fluid passageway extending between the first and second ends, a cartridge holder secured to the second end of the transfer device, the cartridge holder having a needle retained therein, the needle having a first piercing tip and a second piercing tip, the first piercing tip extending into the fluid passageway of the transfer device, a first container receiving portion for receiving and retaining the first container, the second piercing tip extending into the first container receiving portion, a housing secured to the cartridge holder, a plunger rod within the housing, a cover, the cover extending over the transfer device, cartridge holder and housing, the cover and the transfer device having an interlocking arrangement to prevent removal of the cover.

According to a further aspect of the invention, there is also provided a reconstitution arrangement comprising a vial containing a first substance, a syringe containing a second substance, the syringe having a syringe body with an open end, a plunger within the syringe to retain the second substance therein, a transfer device, a cartridge holder secured to the transfer device, the cartridge holder having a needle, the needle having first and second piercing ends, the cartridge holder having a syringe receiving portion, a housing secured to the cartridge holder, a plunger rod within the housing, the plunger rod being sized to fit within the syringe, the plunger rod having a plurality of spaced recesses formed thereon, a sealing member sized to fit within one of the spaced recesses to seal against the syringe body whereby pressure exerted on the plunger rod will cause movement of the plunger within the syringe body.

In one embodiment of the present invention, there is provided a reconstitution arrangement wherein the various elements of the device are packaged in a single package with a cover storing the cartridge holder, transfer device and housing, the cover having an interlocking arrangement to prevent removal thereof. This prevents unauthorized use of the device and as well, leads the user to the correct use of the device. Thus, the cover cannot be removed until the device has been activated by insertion of a vial into the transfer device. This provides a gripping area which will then permit the removal of the cover and access to the contents.

Also, in one embodiment of the present invention, there is provided a plunger rod which has a plurality of spaced recesses formed thereon. Preferably each of the recesses is substantially identical and a sealing member may be placed within one of the spaced recesses. The sealing member ensures a tight seal against the syringe body such that when the plunger rod is pushed, the plunger within the syringe is likewise moved. This can be accomplished without the plunger rod contacting the plunger. This is of substantial advantage since the sealing member may be placed within an appropriate recess depending upon the volume. A further advantage of the arrangement is that the plunger rod, upon aspiration, returns to its original position. Since the plunger rod is not attached to the plunger, accidental removal of the plunger is prevented.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
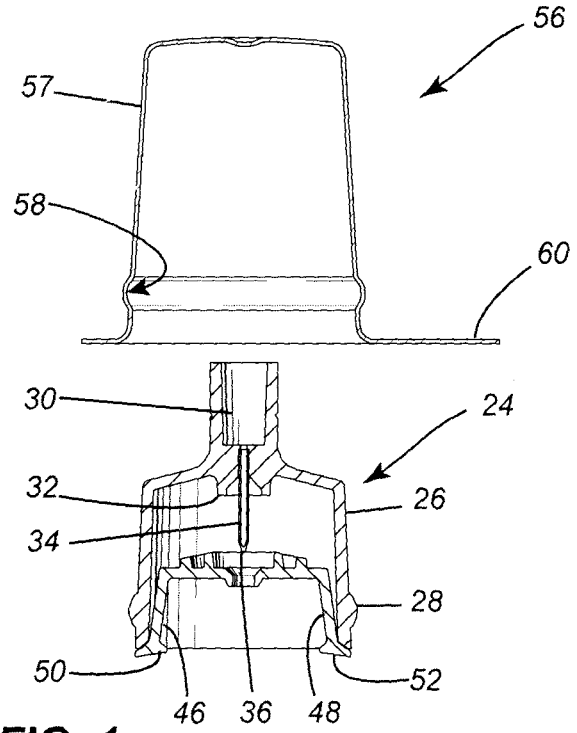
FIG. 1 is a side elevational view of a transfer device according to the present invention.
Figure 2:
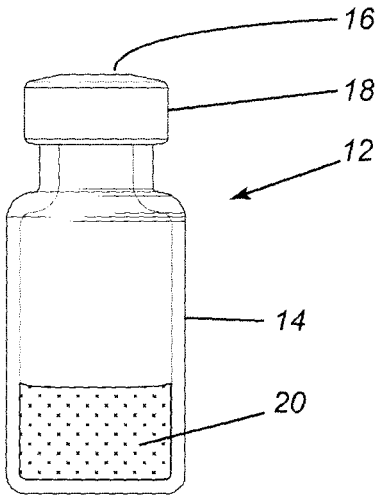
FIG. 2 is a side elevational view, partially in section, of a vial containing a medicant.
Figure 3:
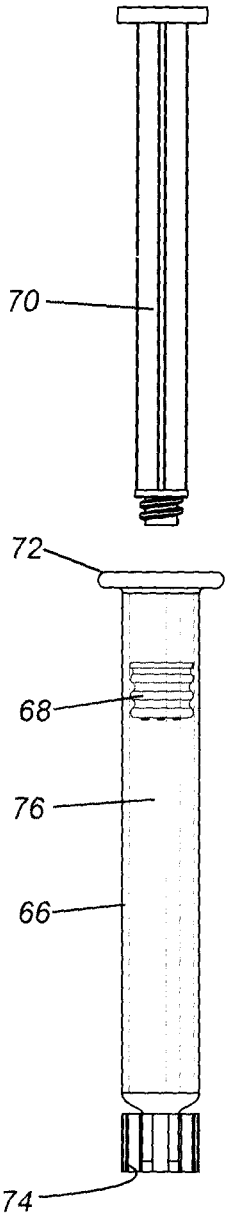
FIG. 3 is a side elevational view of a syringe and plunger rod.
Figure 4:
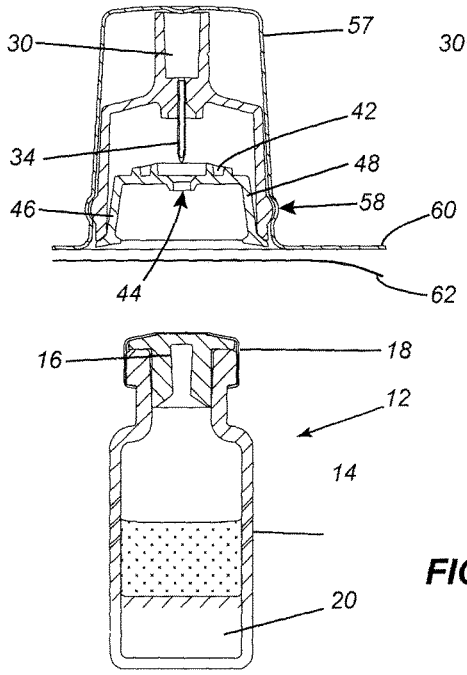
FIG. 4 is a cross sectional view of the transfer device prior to its use.
Figure 5:
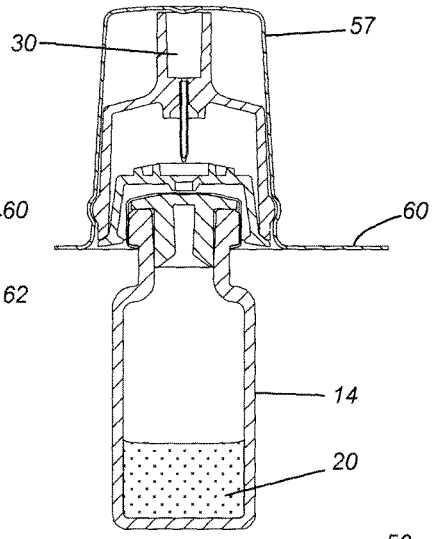
FIG. 5 is a side sectional view of the device being placed on a vial.
Figure 6:
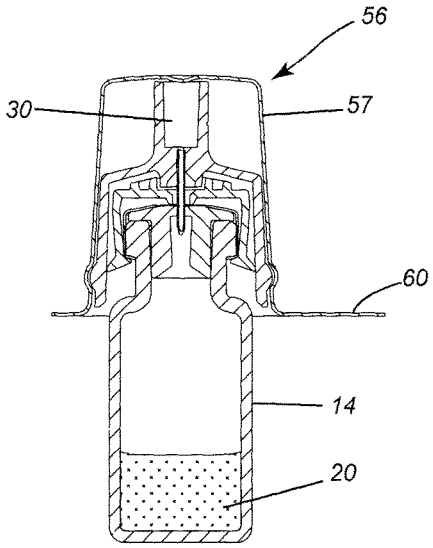
FIG. 6 is a side sectional view showing piercing of the vial.
Figure 7:
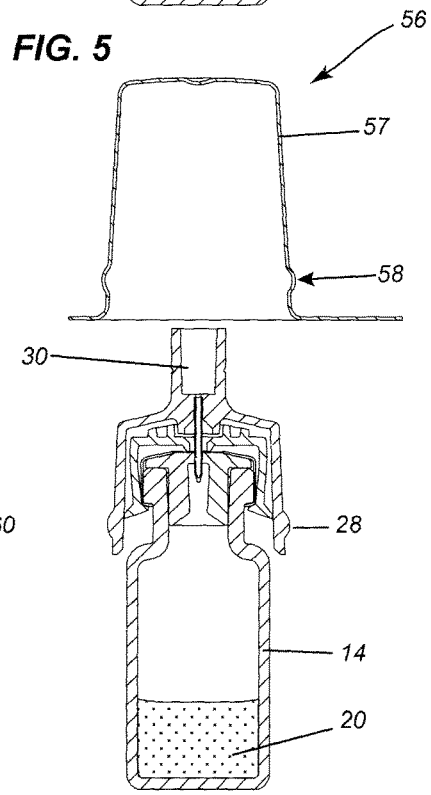
FIG. 7 is a cross sectional view illustrating the cap being removed.

Referring to the drawings in greater detail and by reference characters thereto, there is illustrated a transfer system which is generally designated by reference numeral 10 and which is suitable for use with a vial generally designated by reference numeral 12.

Vial 12 has a body 14 with a neck sealed by a septum 16 over which there is a cap 18. A medicant 20 is contained within body 14 and would typically comprise a dry ingredient although a fluid may also be utilized.

Transfer system 10 includes an outer housing generally designated by reference numeral 24 having a circular side wall 26. On circular side wall 26 there is a protrusion 28 near the bottom thereof. On its upper end, there is provided a luer connection 30. An inner wall 32 mounts a needle 34 which is hollow in nature and has a piercing end 36. As previously mentioned, needle 34 may be a spike.

Mounted interiorly of outer housing 24 is a moveable member 40. Moveable member 40 has a top wall 42 with an aperture 44 centrally located therein to permit the passage of needle 34. Extending downwardly from top wall 42 is a first leg 46 and a second leg 48. First leg 46 has an outwardly extending flange 50 at the bottom thereof while second leg 48 also has an outwardly extending flange 52.

A cover 56 is provided to receive transfer system 10. Cover 56 has a side wall 57 which is adapted to engage with protrusion 28 to retain transfer system 10 in position. Side wall 57 is provided with an outwardly extending flange 60 at the bottom thereof. Flange 60 is designed to receive a peelable sealing strip 62 so as to provide a hermetically sealed package.

The transfer system of the present invention is preferably utilized with a syringe which has a syringe body 66 and a plunger 68 mounted therein. A plunger rod 70 is designed to be screwthreadably engageable with plunger 68. Syringe body 66 includes a backstop 72 to permit proper gripping by the hand of a user. At its front end, syringe body 68 includes a luer connector 74. Typically, syringe body 66 is filled with a diluent 76 although any desired fluid may be utilized.

Figure 8:
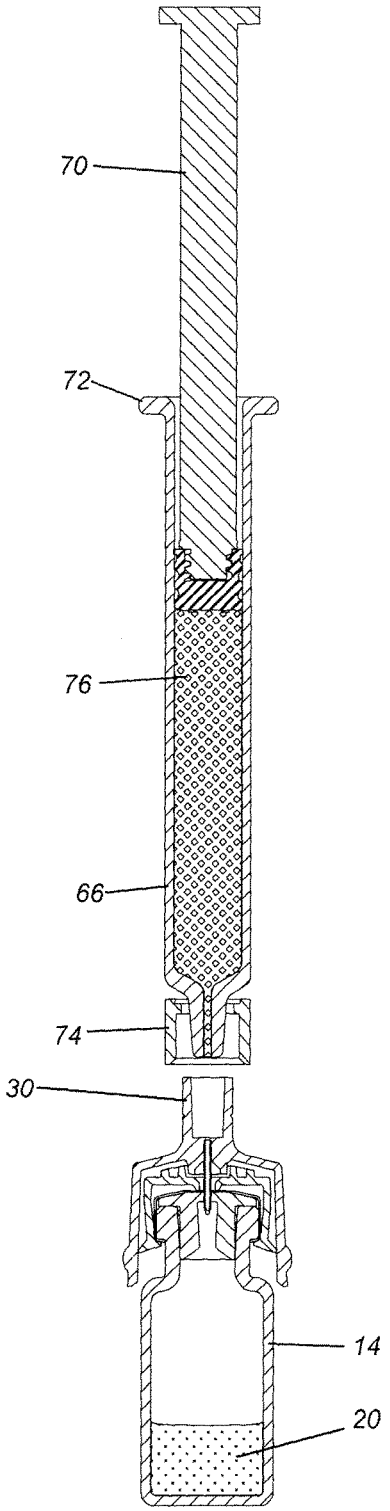
FIG. 8 is a cross sectional view illustrating a luer lock syringe being ready to be placed on the vial.
Figure 9:
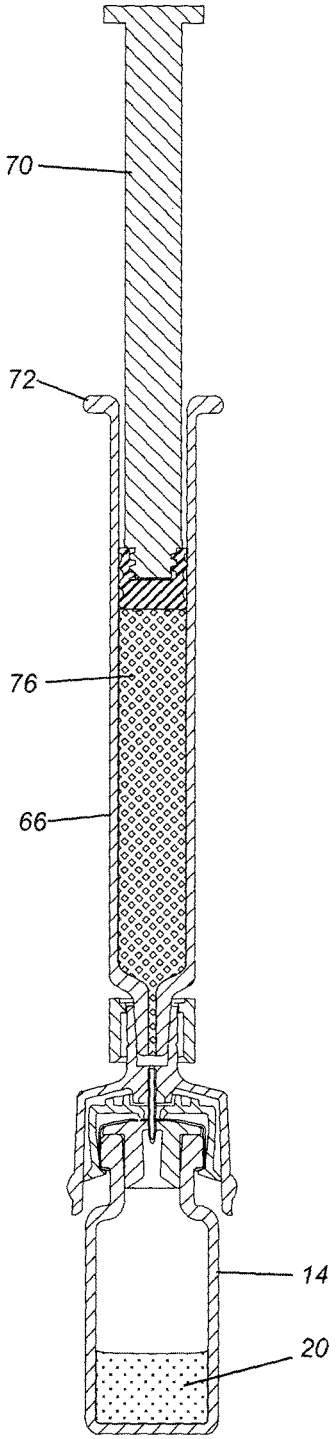
FIG. 9 is a view, partially in cross section, of a luer lock syringe being attached to the transfer device.
Figure 10:
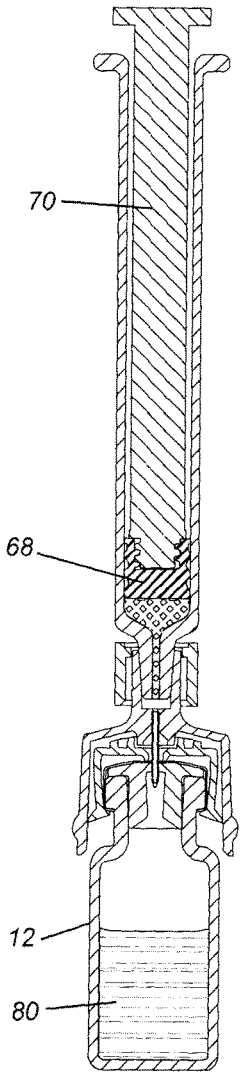
FIG. 10 is a sectional view illustrating the mixing of components.
Figure 11:
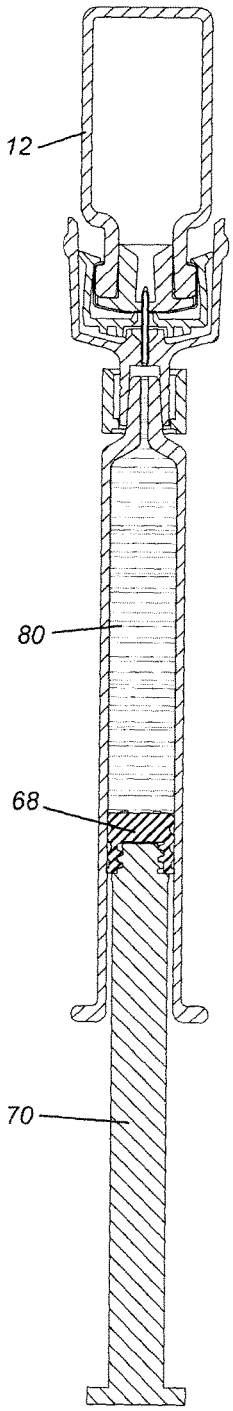
FIG. 11 is a sectional view illustrating the aspiration of the mixture into the syringe.
Figure 12:
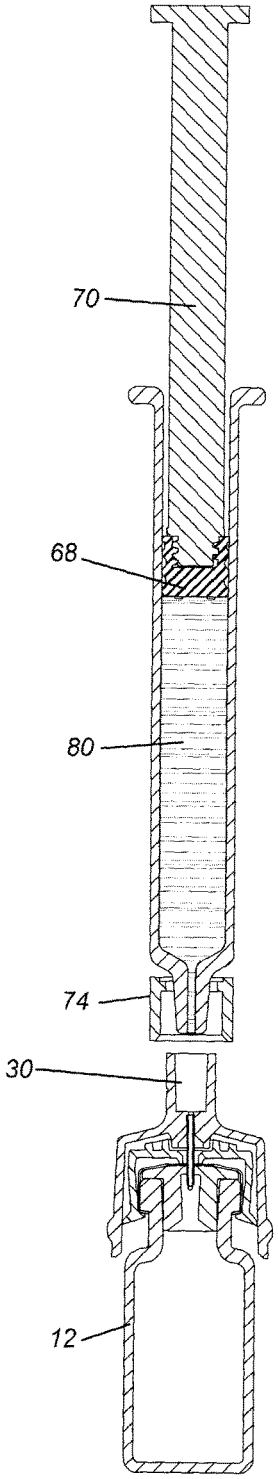
FIG. 12 is a sectional view showing the syringe being detached.
Figure 13:
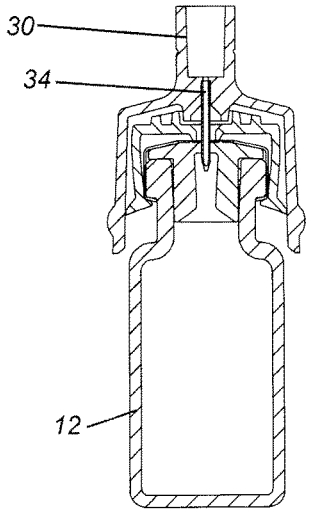
FIG. 13 is a cross sectional view illustrating placement of the transfer assembly on a vial.
Figure 14:
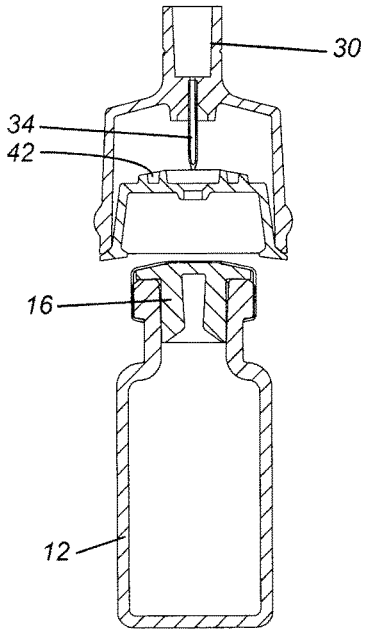
FIG. 14 is an exploded view illustrating the transfer assembly and the vial prior to insertion of the vial.
Figure 15A:
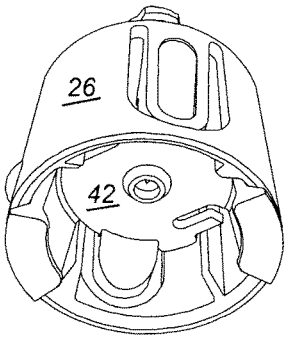
FIG. 15A is a bottom perspective view of a transfer assembly according to one embodiment of the present invention.
Figure 16A:
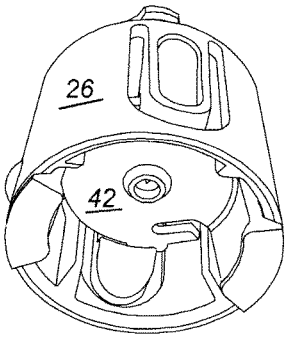
FIG. 16A is a perspective view of the transfer assembly according to a further embodiment.
Figure 15B:
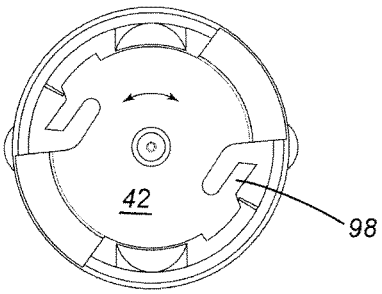
FIG. 15B is a bottom plan view thereof.
Figure 16B:
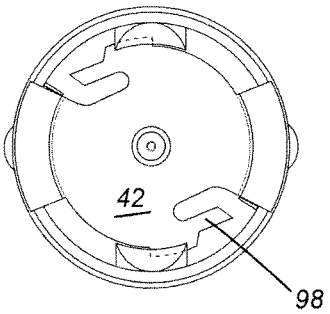
FIG. 16B is a bottom plan view thereof.
Figure 17A:
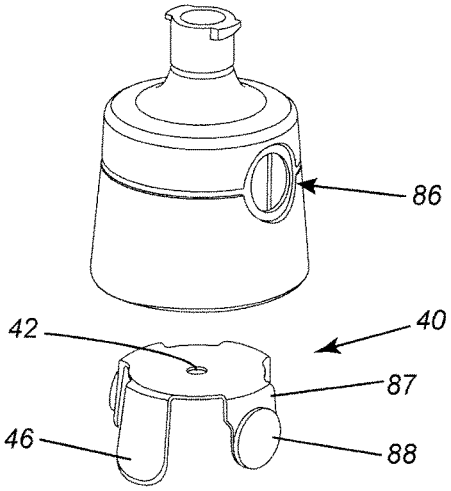
FIG. 17A is an exploded view of the transfer assembly.
Figure 17B:
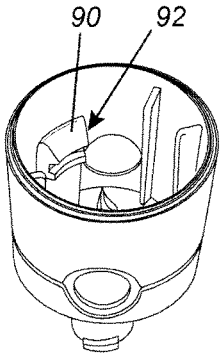
FIG. 17B is a bottom perspective view thereof.
Figure 17C:
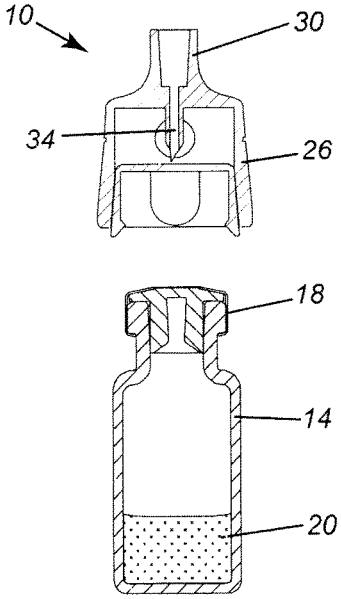
FIGS. 17C to 17E show the sequence of placing the transfer assembly on the vial.
Figure 17D:
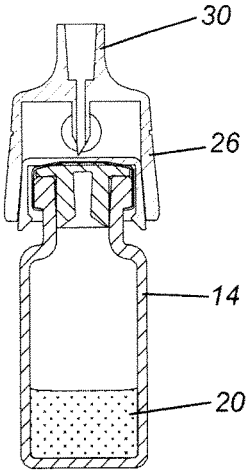
Figure 17E:
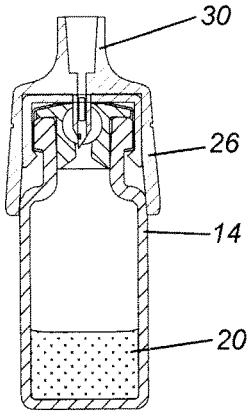
Figures 17F, 17G, 17H:
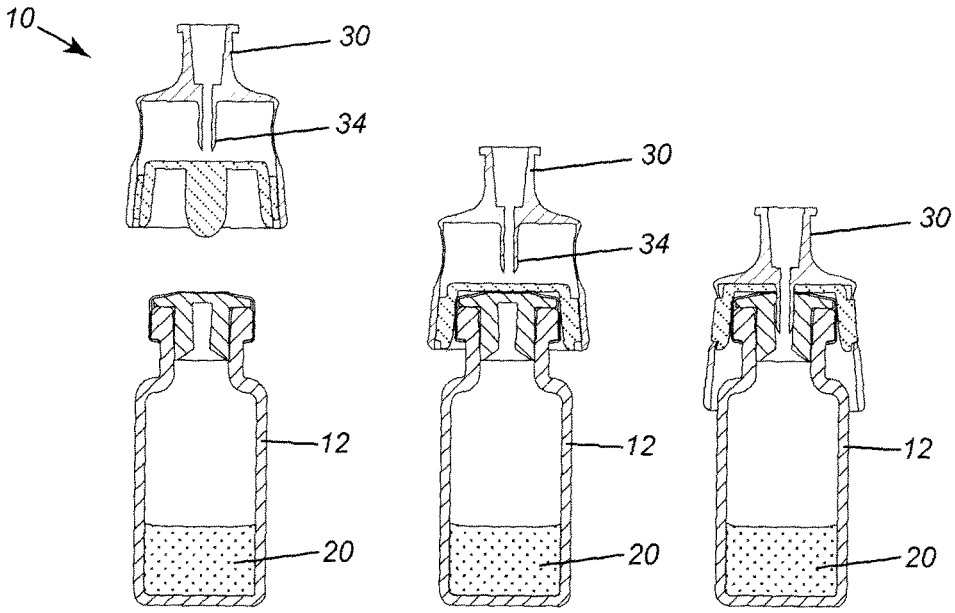
FIGS. 17F to 17H illustrate the placement of the transfer assembly in a further embodiment thereof on a vial.

As shown in FIGS. 8 and 9, plunger rod 70 is connected to plunger 68 and the diluent 76 is then forced into vial body 14 as shown in FIG. 10. The medicant and diluent may then be mixed and the assembly inverted as shown in FIG. 11. The mixture 80 is then aspirated back into syringe body 66. The mixture 80 is then ready for injection when a needle assembly is connected to luer connector 74.

In the embodiment of FIGS. 17A to 17H, it will be noted that outer housing 24 is provided with a pair of apertures 86 in side wall 26. Also, in this embodiment, there are provided an extra pair of legs 87 each having buttons 88 formed on an exterior surface thereof. In this embodiment, when the moveable member 40 moves upwardly, buttons 88 engage in apertures 86.

On the interior surface of wall 26, there are provided latches 90 which have a groove 92 formed therein. Thus, when pressure is exerted on buttons 88 as vial 12 is being withdrawn, moveable member 40 will move downwardly until the top wall 42 engages with groove 92. This retains moveable member 40 in position for further use.

Figure 18:
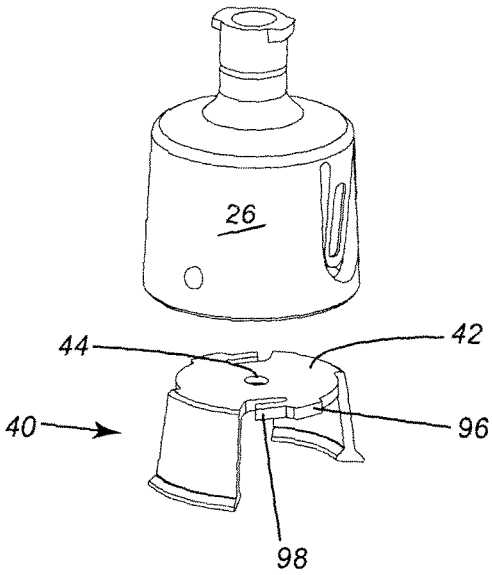
FIG. 18 is an exploded view of the transfer assembly.
Figure 19A:
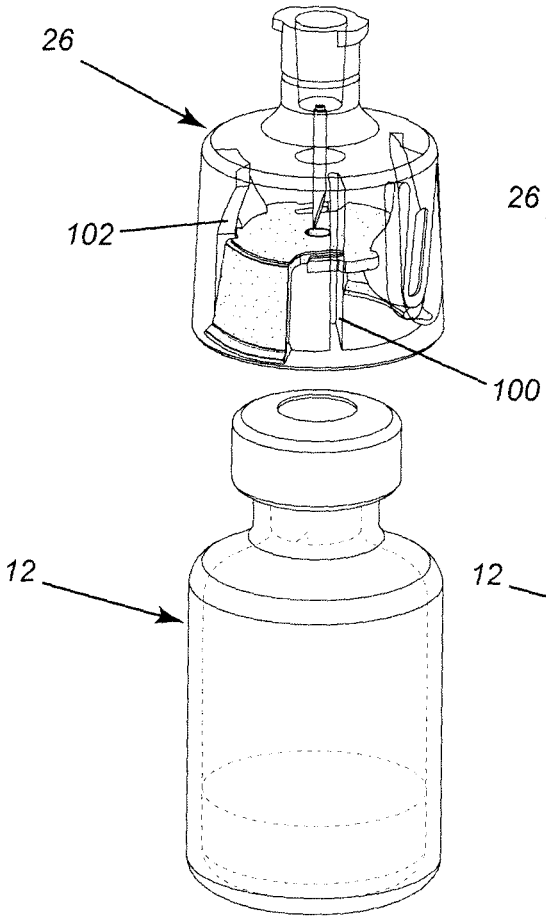
FIGS. 19A to 19D are perspective views illustrating placement of the transfer assembly on a vial and removal thereof.
Figure 19B:
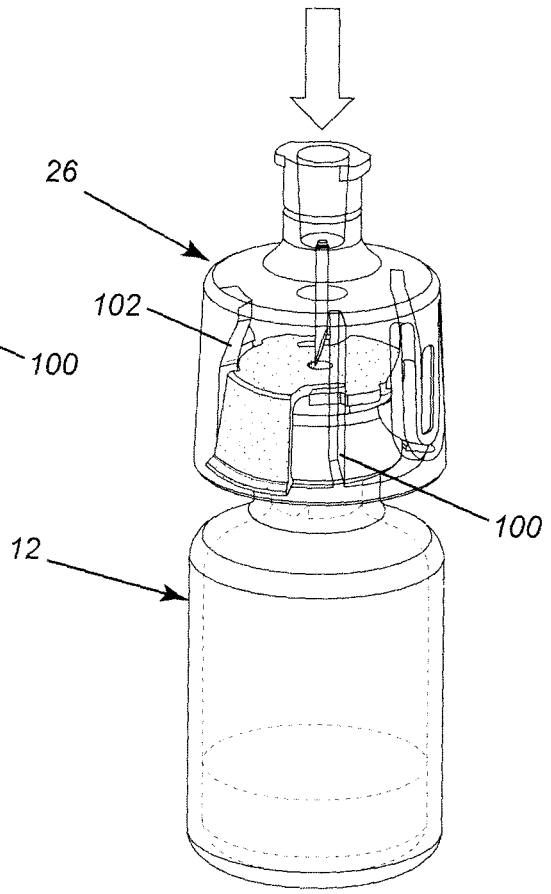
Figure 19C:
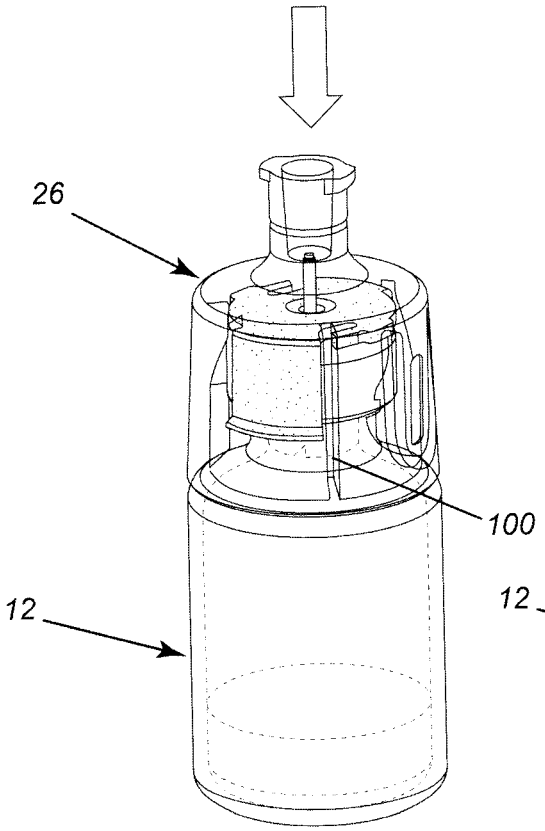
Figure 19D:
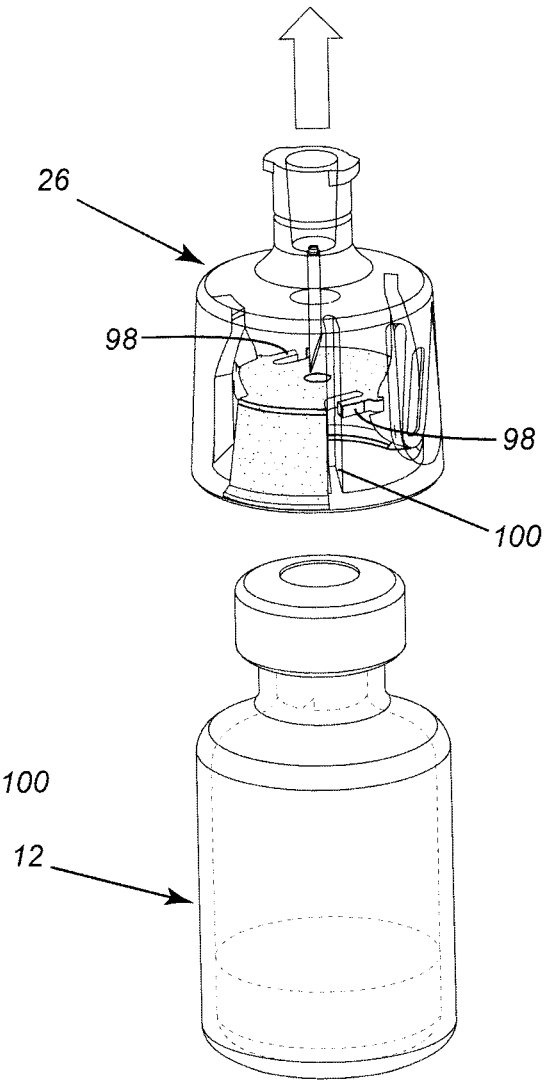
Figure 20:
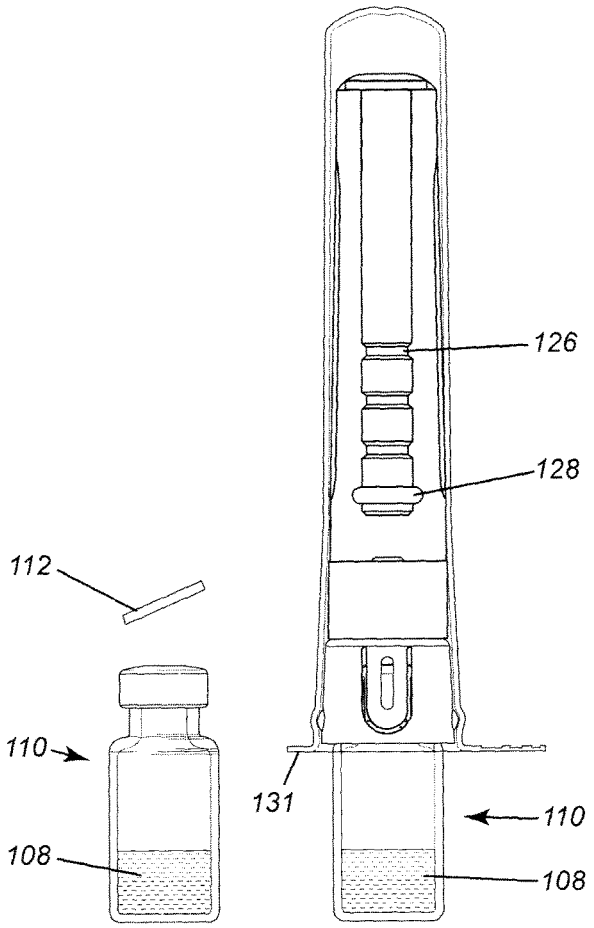
FIGS. 20 to 29 are elevational views illustrating the sequence of operation of the reconstitution arrangement of the present invention.

In the embodiment of FIGS. 18 to 19D, it will be noted that top wall 42 is provided with protrusions 96 and locking latches 98. On the interior there are provided ribs 100 and angled side wall portions 102. The arrangement is such that upon upward movement of moveable member 40, protrusions 96 engage with angled side wall 102 to rotate moveable member 40. Upon withdrawal, locking latches 98 engage with rib 100 so as to prevent further use of the transfer member.

In the embodiment of FIGS. 20 to 30, there is provided a vial 110 having a cover 112 and containing a medicant 108. A linking device generally designated by reference numeral 114 may be that described in the previous figures including needle 145 having piercing tip 119 or alternatively, can be any available linking device.

The linking or transfer device 114 of the present invention has a first end 111 and a second end 113 and includes an outer housing 118 having internal threads 120 at one end thereof. At the other end there is an aperture 121. A plunger rod 122 extends through aperture 121 and includes a head 124. Extending circumferentially of plunger rod 122 are a plurality of grooves 126. An O ring 128 is provided and is placed in a desired location in one of the grooves 126.

The reconstitution arrangement will include a cover 130 which is retained on outer housing 118 by means of a recess 132 on cover 130 which engages with protrusions 134 on outer housing 118. Thus, as may be seen in FIG. 30, cover 130 is not easily removed as there is no place to grip the inner housing to separate it from cover 130. Cover 130 includes a flange 131 which may accommodate a seal extending thereacross.

Figure 21:
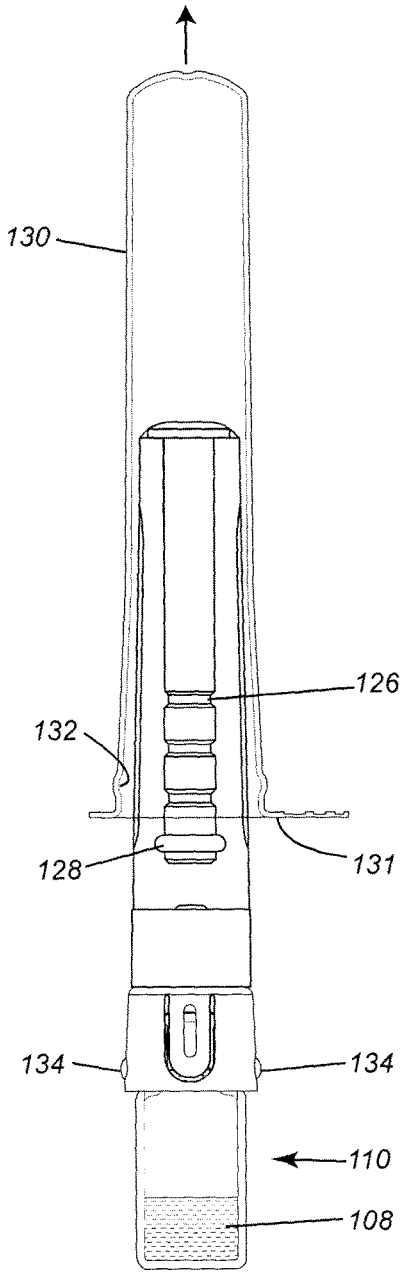

However, when vial 110 is inserted in linking component 114, the vial provides a place to grip and cover 130 may be pulled off from outer housing 118 as shown in FIG. 21.

A cartridge holder generally designated by reference numeral 138 has a pair of legs 140 extending upwardly therefrom. Threads 142 are located on the exterior of cartridge holder 138 such that cartridge holder 138 may be engaged with outer housing 118 by threads 120. Cartridge holder 138 includes a needle 144 having piercing tip 117 which may be staked therein and which communicates with needle 145 of linking device 114 to thereby form a fluid passageway. Cartridge holder 138 also includes threads 139 which engage with the threads on linking device 114.

The use of an O ring 128 with a plurality of grooves 126 permits customization of the device depending upon the size of vial 110. In other words, O ring 128 may be placed in any one of the grooves 126 depending on the volume of the diluent in cartridge 136. A plunger 125 seals one end of cartridge 136.

In operation, and as shown in FIGS. 20 to 29, vial 110 is inserted into transfer device 114. This then permits the user to grasp cover 130 and vial 110 and thereby permits the removal of cover 130 as shown in FIG. 21.

Figure 22:
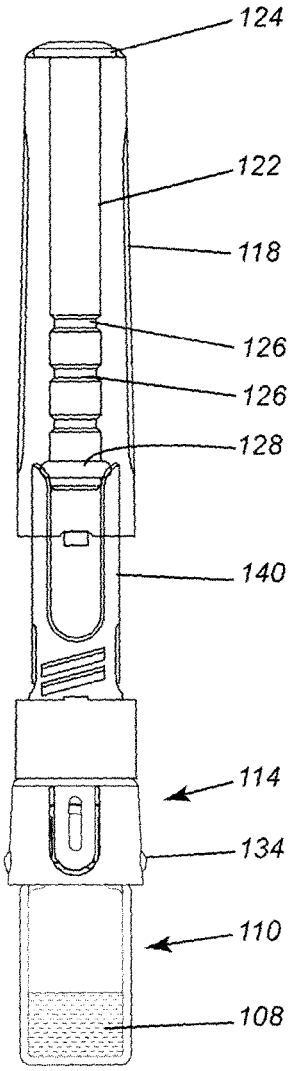
Figure 23:
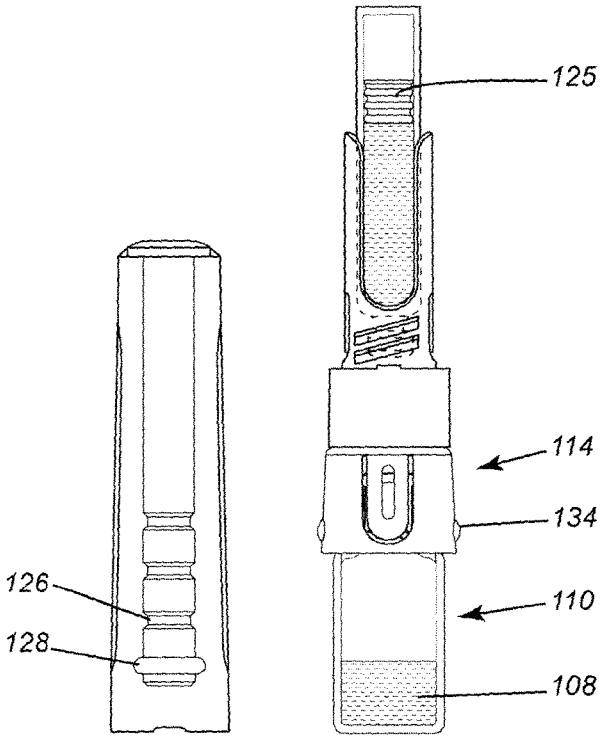

Subsequently, outer housing 118 may be removed to permit the placement of cartridge 136 within cartridge holder 138 as shown in FIGS. 22 and 23. This causes piercing by needle 114.

Figure 24:
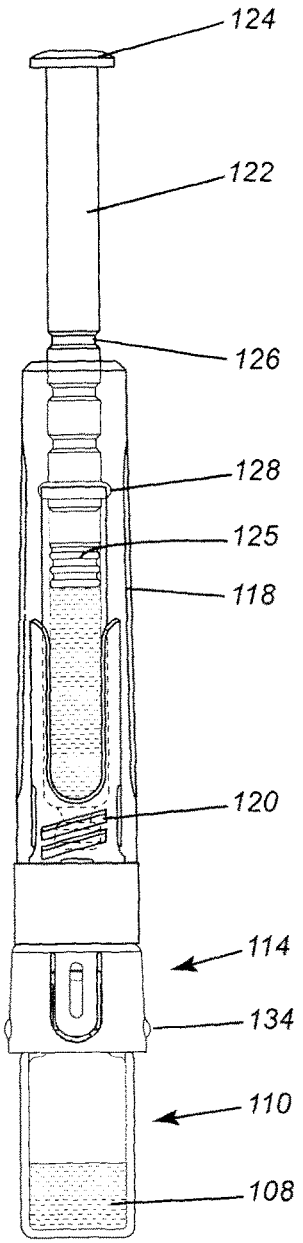
Figure 25:
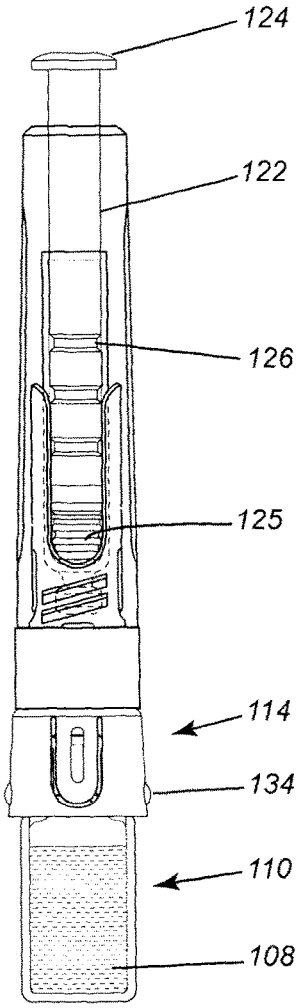

Outer housing 118 is then reattached to expose head 124 of plunger rod 122. Pressure is then exerted on plunger rod head 124. This is illustrated in FIGS. 24 and 25 and will thereby cause the transfer of diluent from cartridge 136 to vial 110.

Figure 26:
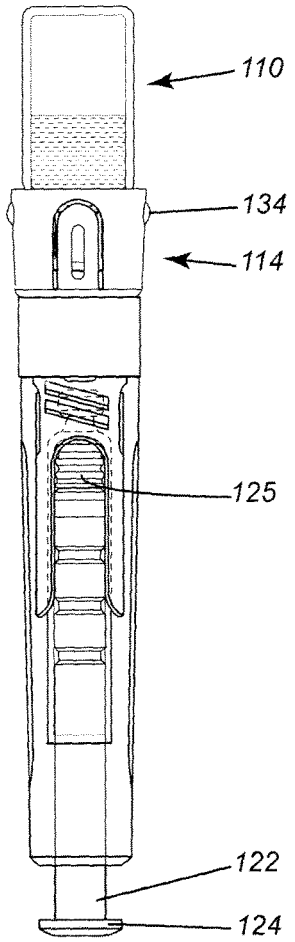
Figure 27:
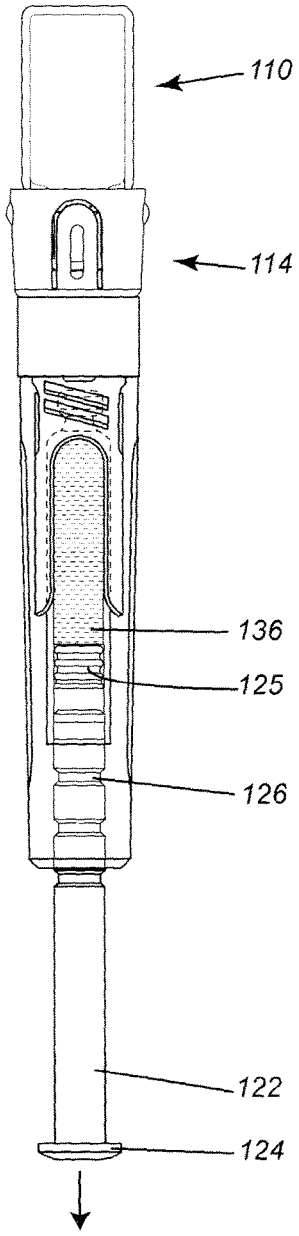
Figure 28:
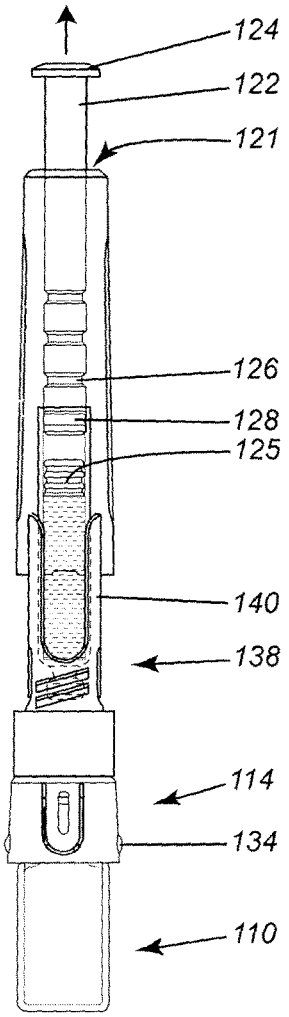
Figure 29:
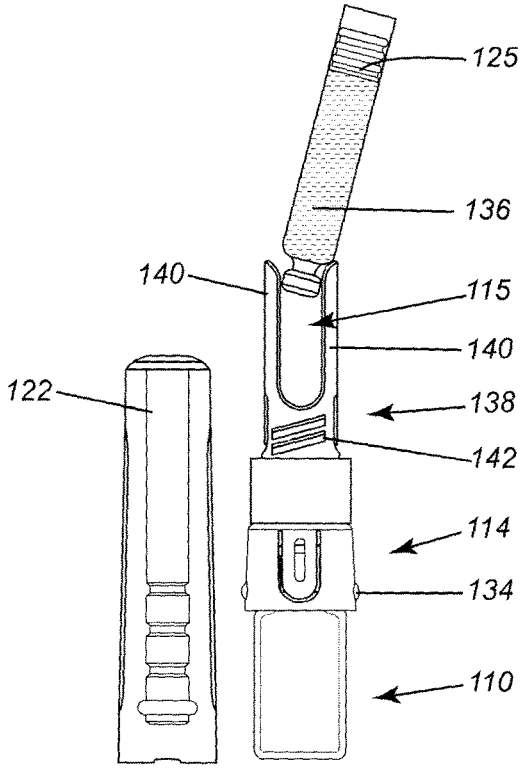
Figure 30:
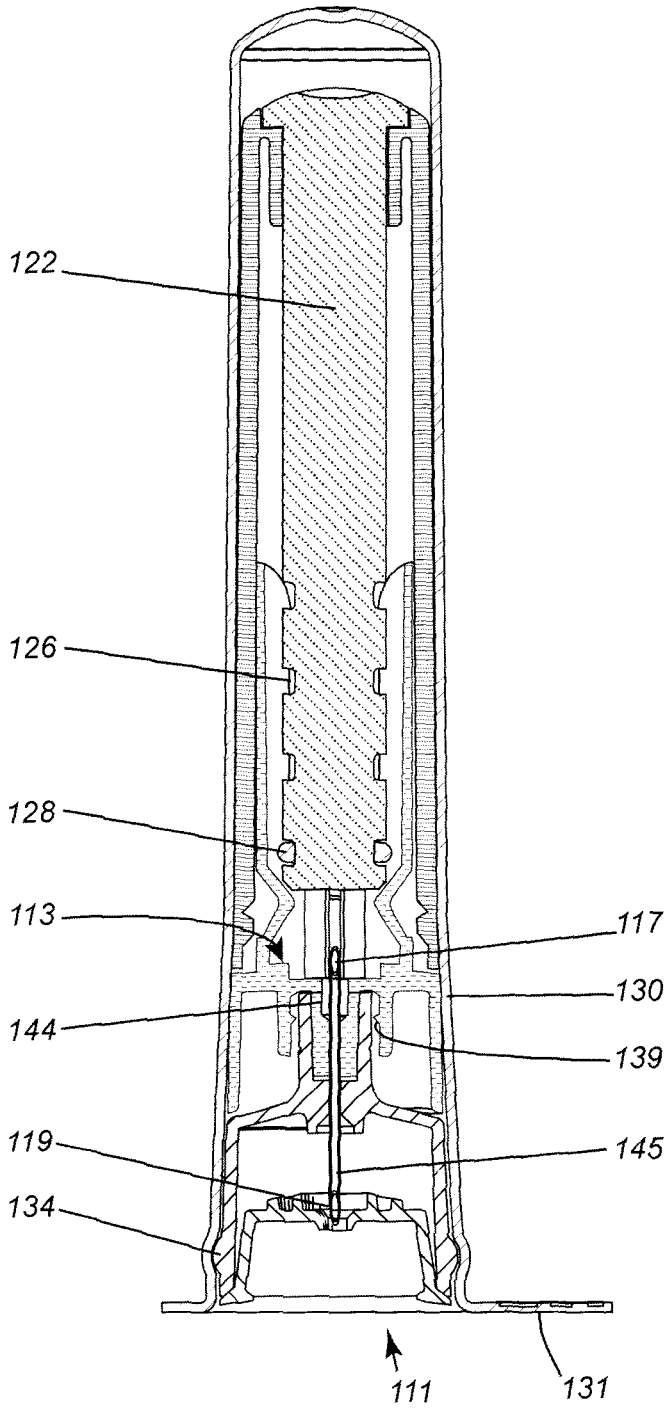
FIG. 30 is a cross sectional view of the device as seen in FIG. 20.

Subsequently, as shown in FIGS. 26 and 27, the device may be turned upside down and vial 110 shaken to ensure proper mixing of the diluent and active ingredient. Plunger rod 122 may then be pulled outwardly to aspirate such that the mixture is transferred back into cartridge 136. The use of O ring 128 and the lack of contact with the plunger ensure that the plunger remains in cartridge 136 in the proper position. Subsequently, outer housing 118 may be screwthreadably disengaged from cartridge holder 138. This permits the removal of cartridge 136 for use in a pen type injector.

Naturally, it will be understood that other options could be utilized. Thus, one could remove linking device 114 and suitable connections (a luer connection) may be provided to permit the use of a needle for direct injection. Also the needle may be formed as a single member or as two components as shown herein. Reference to a single needle includes the two component arrangement.

We claim:

1. A reconstitution arrangement for use in transferring the contents of a first container (136) to mix with the contents of a second container (110) and subsequently retransferring the mixture to said first container (136), the reconstitution arrangement comprising:

a transfer device (114), said transfer device having first and second opposed ends (111, 113), said first end (111) being open for receiving said second container (110), a fluid passageway extending between said first and second ends (111, 113);

a cartridge holder (138) secured to said second end (113) of said transfer device, said cartridge holder having a needle (144, 145) retained therein, said needle having a first piercing tip (117) and a second piercing tip (119), said first piercing tip (117) extending into said fluid passageway of said transfer device, a first container receiving portion (115) for receiving and retaining said first container (136), said second piercing tip (119) extending into said first container receiving portion (115);

a housing (118) secured to said cartridge holder (138), a plunger rod (122) within said housing;

a cover (130), said cover extending over said transfer device (114), cartridge holder (138) and housing, said cover and said transfer device having an interlocking arrangement to prevent removal of said cover (130), the interlocking arrangement being such that said cover (130) can be removed when said second container (110) is inserted into said transfer device (114) thereby providing a gripping area to permit removal of said cover (130).

2. The reconstitution arrangement of claim 1 wherein said plunger rod (122) has a plurality of recesses (126) formed thereon, each recess (126) being substantially identical and spaced from each other along a length of said plunger rod (122), a sealing member (128) sized to fit within one of said recesses to seal against a wall of said first container (136), whereby pressure exerted on said plunger rod (122) will cause movement of a plunger in said first container, said plunger rod (122) being spaced apart from said plunger.

3. The reconstitution arrangement of claim 1 wherein said transfer device (114), said cartridge holder (138) and said housing are screwthreadably (120, 142) engaged with each other.

4. The reconstitution arrangement of claim 1 wherein said transfer device (114) has protrusions (134) on an exterior surface thereof, said cover (130) having recesses (132) designed to engage with said protrusions (134) to prevent removal of said cover (130).

5. The reconstitution arrangement of claim 4 wherein said housing (118) has an aperture (121), said plunger rod (122) extending through said aperture (121).

6. The reconstitution device of claim 1 wherein said second container (110) is a vial, said vial containing a medicant (108).

7. The reconstitution arrangement of claim 6 wherein said first container (136) is a cartridge, said cartridge containing a diluent.

8. The reconstitution arrangement of claim 1 wherein said plunger rod has a plurality of spaced recesses (126) formed thereon, a sealing member (128) to fit within one of said spaced recesses to seal against said cartridge body.

9. The reconstitution arrangement of claim 1 wherein said container receiving portion (115) comprises a pair of wall members (140) extending outwardly from said cartridge holder, said walls (140) being spaced apart by a distance equal to the width of said first container.

10. A reconstitution arrangement comprising:

a vial (110) containing a first substance (108);

a cartridge (136) containing a second substance, said cartridge having a body with an open end, a plunger within said cartridge to retain said second substance therein;

a transfer device (114);

a cartridge holder (138) secured to said transfer device (114), said cartridge holder (138) having a needle (144, 145), said needle having first (117) and second (119) piercing ends, said cartridge holder having a cartridge receiving portion;

a housing (118) secured to said cartridge holder (138);

a plunger rod (122) within said housing (118), said plunger rod being sized to fit within said cartridge, said plunger rod (122) being spaced apart from said plunger, said plunger rod having a plurality of spaced recesses (126) formed thereon, a sealing member (128) sized to fit within one of said spaced recesses to seal against said cartridge body whereby pressure exerted on said plunger rod (122) will cause movement of said plunger (125) within said syringe body.

11. The transfer device of claim 10 wherein said cartridge holder (138) and said housing (118) are screwthreadably engaged.

12. The transfer device of claim 10 wherein said vial contains a medicant (108) and said cartridge (136) contains a diluent.

* * * * *